United States Patent [19]

Sarcia

[11] Patent Number: 4,792,346

[45] Date of Patent: Dec. 20, 1988

[54] METHOD AND APPARATUS FOR SNUBBING THE MOVEMENT OF A FREE, GAS-DRIVEN DISPLACER IN A COOLING ENGINE

[76] Inventor: Domenico S. Sarcia, 114 Sunset Rd., Carlisle, Mass. 01741

[21] Appl. No.: 21,258

[22] Filed: Mar. 3, 1987

[51] Int. Cl.[4] ..... F25B 9/00

[52] U.S. Cl. ..... 62/6; 60/520

[58] Field of Search ..... 60/517, 520, 518; 62/6

[56] References Cited

U.S. PATENT DOCUMENTS 3,991,586 11/1976 Acord ..... 60/520 X 4,475,335 10/1984 Davey ..... 60/520

*Primary Examiner*—Stephen F. Husar

*Attorney, Agent, or Firm*—Richard J. Birch

[57] ABSTRACT

A method and apparatus for snubbing the movement of a free, gas-driven displacer in a cooling engine are disclosed. The reciprocal movement of the free, gas-driven displacer is snubbed in each direction of movement as the displacer approaches top dead center and bottom dead center of its cycle by means of a magnetic snubber. Magnetic repulsion forces are generated between the displacer and the displacer containing cylinder of the cooling engine as the displacer approaches both top dead center and bottom dead center of its cycle. Each magnetic repulsive force is non-linear with respect to the displacer and the corresponding end of the displacer containing cylinder.

18 Claims, 8 Drawing Sheets

METHOD AND APPARATUS FOR SNUBBING THE MOVEMENT OF A FREE, GAS-DRIVEN DISPLACER IN A COOLING ENGINE

BACKGROUND OF THE INVENTION

The present invention relates to cooling engines in general and, more particularly, to cooling engines having a free, gas-driven displacer.

Traditionally, free displacer, i.e., free piston cooling engines, work well thermodynamically, but lack sufficient reliability over a long period of time for them to be commercially successful against the currently available mechanical driven cooling engines. The problem with a free, gas-driven displacer is controlling the motion of the displacer at the top dead center and the bottom dead center of its cycle. In order to achieve high thermodynamic efficiency, the volumes at top dead center (TDC) and bottom dead center (BDC) should approach zero. With free displacer machines, this objective is very difficult to achieve without collisions taking place between the displacer and cylinder containing the displacer.

It is, accordingly, a general object of the present invention to provide both a method and apparatus for snubbing the movement of a free, gas-driven displacer in a cooling engine.

It is a specific object of the invention to utilize magnetic repulsion forces to provide the desired snubbing action for the free, gas-driven displacer.

It is another object of the invention to control the snubbing of a free, gas-driven displacer on a non-linear basis that varies inversely with the distance between the displacer and the ends of the displacer containing cylinder at TDC and BDC.

It is a feature of the invention that the method can be practiced and the apparatus constructed utilizing relatively inexpensive and commercially available magnetic components.

It is another feature of the invention that the "bang - bang" operation of conventional free, gas-driven displacer machines is eliminated with a concomittant increase in the reliability and longevity of such cooling engines.

BRIEF SUMMARY OF THE INVENTION

The present invention utilizes a magnetic repulsion force between the displacer and each end of the cylinder containing the displacer. Two stationary magnets are placed at the ends of the displacer containing cylinder and the displacer itself has two movable magnets attached to the ends of the displacer in such a manner that they act as magnetic springs, i.e., the like magnetic poles of the stationery and movable magnets at one end face each other and, similarly, the like magnetic poles of the stationery and movable magnets at the other end of the displacer and cylinder face each other.

As the displacer approaches one end of the cylinder, the repulsion force of the magnetic spring stores the kinetic energy of the displacer and prevents a collision from taking place. When the displacer is allowed to move in the other direction, the stored energy is converted back into kinetic energy in the opposite direction. Thus, the displacer is essentially suspended between the two magnetic repulsion forces which prevent collisions between the displacer and the ends of the displacer containing cylinder. Due to the changing pressures during cycling on the underside of the displacer drive piston, the force vector is biased in one direction or the other to provide movement of the displacer during its conventional cycle.

BRIEF DESCRIPTION OF THE DRAWINGS

The objects and features set forth above wil best be understood from a detailed description of a preferred embodiment of the invention, selected for purposes of illustration, and shown in the accompanying drawings, in which.

DETAILED DESCRIPTION OF THE INVENTION

Figure 1:
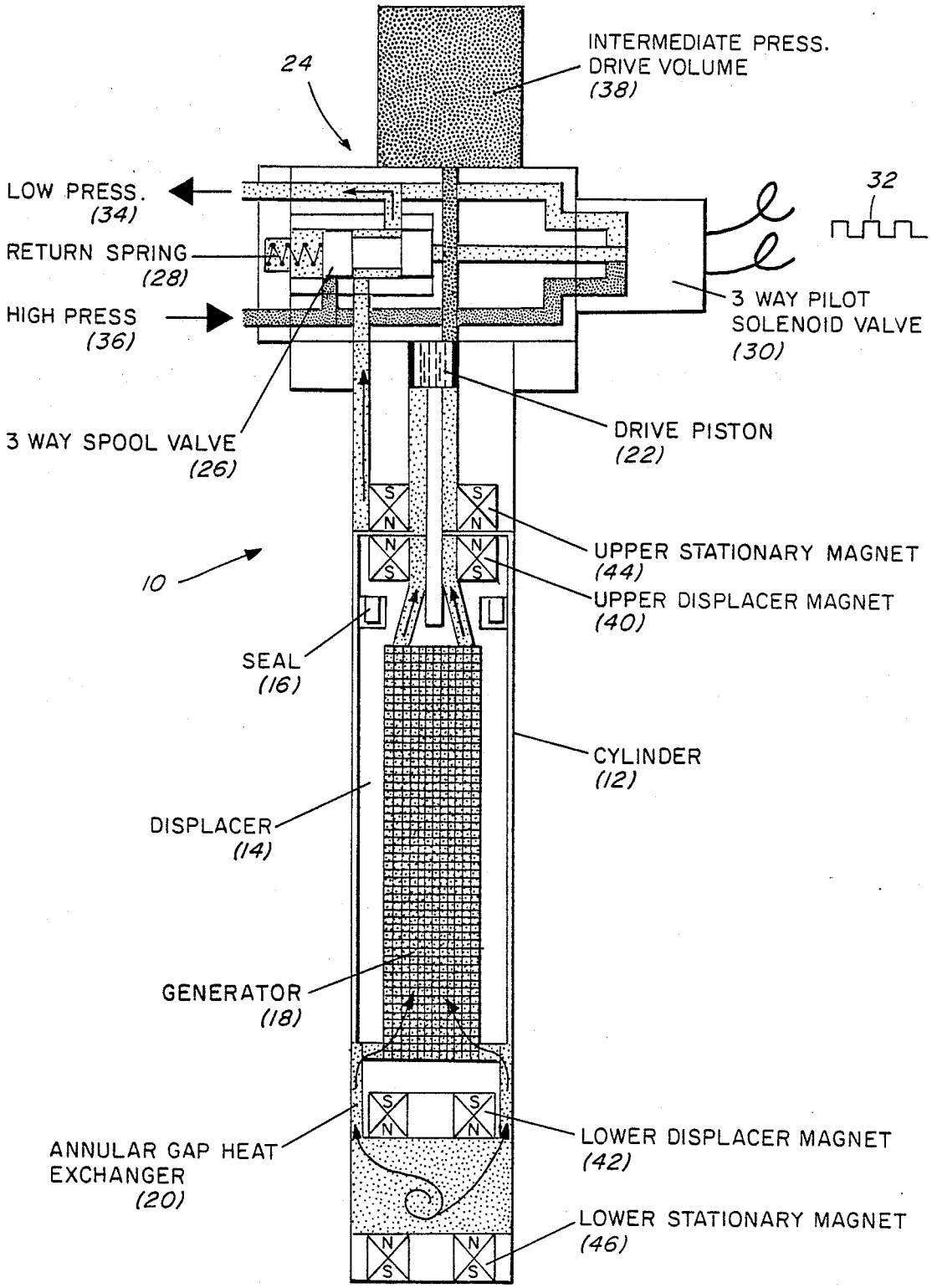
FIG. 1 is a diagrammatic view in side elevation showing a cooling engine having a free, gas-driven displacer and magnetic snubbers with the displacer shown in its upper position.

Turning now to the drawings, and particularly to FIG. 1 thereof, there is shown in diagrammatic form and side elevation a cooling engine indicated generally by the reference numeral 10. The cooling engine 10 has an expander cylinder 12 within which is located a free, gas-driven displacer 14 having a cylinder wall seal 16. A conventional screen regenerator 18 is located within the displacer to permit bi-directional fluid flow through the displacer. A standard annular gap heat exchanger 20 is located at the lower end of displacer 14 as viewed in FIG. 1.

The reciprocally movable displacer 14 is mechanically coupled to a drive piston 22 that is driven by the differential fluid pressures applied to the drive piston as will be described below.

A fluid valve assembly, indicated generally by the reference numeral 24, comprises a three-way spool valve 26, a return spring 28 and a three-way pilot solenoid valve 30 that is actuated by a square wave control signal 32.

The valve assembly 24 is coupled to a source of low pressure gas 34, and a source of high pressure gas 36. An intermediate pressure drive volume 38 supplies an intermediate pressure gas to the upper piston surface of drive piston 22 as viewed in FIG. 1. The pressure applied to the lower surface of the drive piston is controlled by the position of the three-way spool valve 26 so that either high pressure or low pressure can be applied to the lower surface of the drive piston 22.

The "snubbing" of the displacer 14 as it approaches both top dead center (TDC) and bottom dead center (BDC) is achieved by generating a magnetic repulsion force between the displacer and the corresponding end of the displacer containing cylinder 12. Looking at FIG. 1, the displacer has an upper displacer magnet 40 and a lower displacer magnet 42. Corresponding upper and lower stationary magnets 44 and 46, respectively, are mounted within the cooling engine cylinder 12. The upper displacer magnet 40 and upper stationary magnet 44 are positioned so that like magnetic poles face each other to generate a magnetic repulsion force as the upper displacer magnet approaches the upper stationary magnet on the upstroke of the displacer 14 as viewed in FIG. 1. Similarly, the lower displacer and stationary magnets 42 and 46 are also positioned with their like poles facing each other.

Having described the structure of the cooling engine with its magnet snubbers comprising the upper magnets 40 and 44 and the lower magnets 42 and 46, the operation of a full cycle of the cooling engine will now be discussed in connection with FIGS. 1 through 6.

In FIG. 1, the square wave control signal 32 has de-energized the three-way pilot solenoid valve 30 thereby equalizing the pressure across spool valve 26. The return spring 28 of the valve assembly pushes the spool to the right hand (as viewed in FIG. 1) exhaust position and allows the cold high pressure gas in the cold end of the expander (the lower end as viewed in FIG. 1) to flow upwardly through the annular gap heat exchanger 20 and into the wire matrix material of screen regenerator 18 thereby cooling the screen material as the gas flows upwardly therethrough. As the gas exits the warm upper end (as viewed in FIG. 1) of the regenerator 18, the temperature of the gas is near, but above, ambient. The regenerator action produces a net heat removal from the cold end to the warm removal end. The gas then flows through the spool valve 26 and exhausts to the low pressure source 34.

The upward flow of the gas through the regenerator 18 produces a force that holds the displacer 14 in the upward position during the exhaust part of the cycle. This upward force counteracts both the downward force of the piston and the magnetic repulsion force generated by the upper stationary magnet 44 and upper displacer magnet 40.

Figure 2:
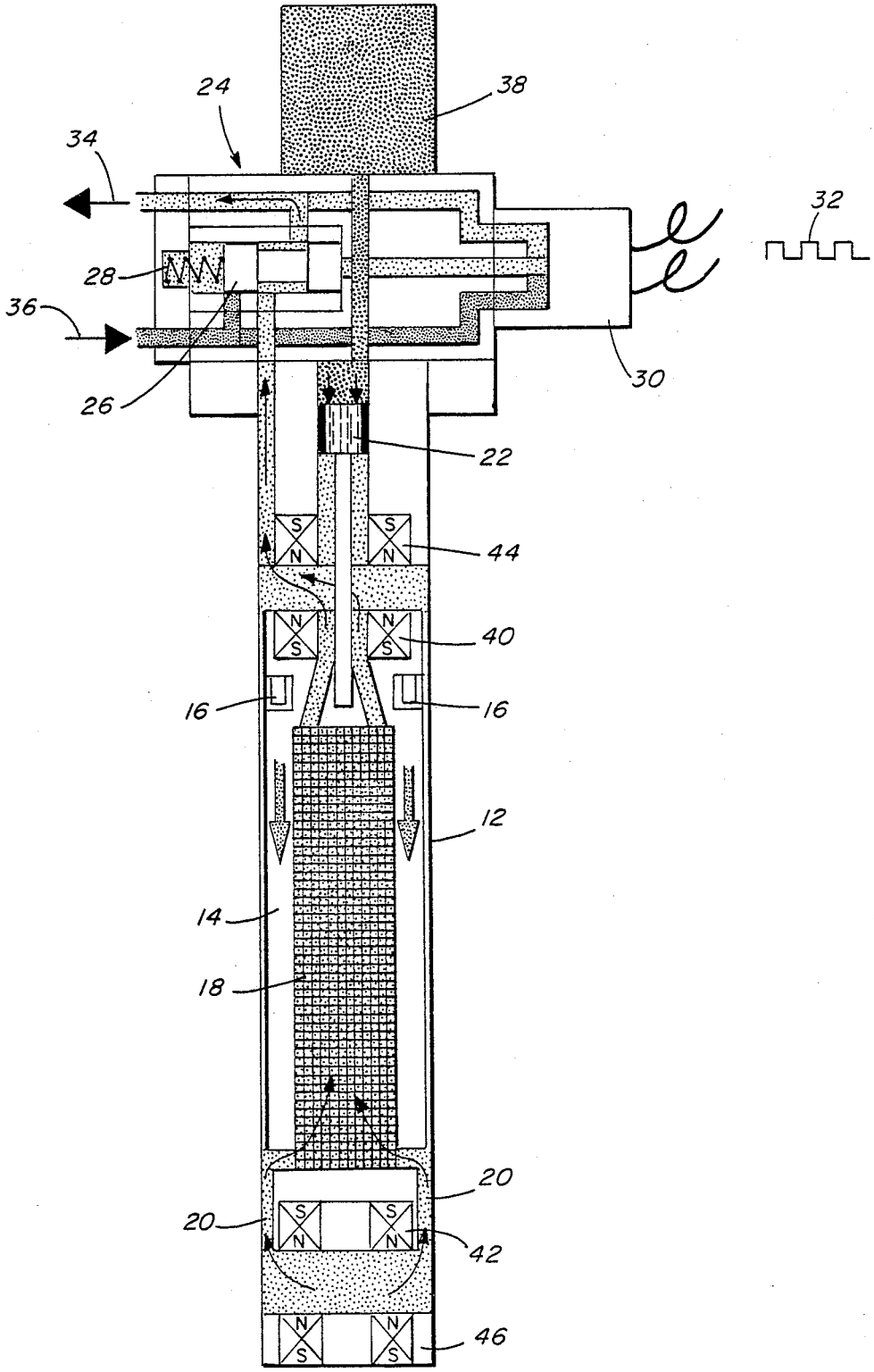
FIG. 2 is a view similar to that of FIG. 1 with the displacer shown moving downwardly as viewed in the drawing.

When the exhaust pressure drops below the intermediate pressure from intermediate pressure drive volume 38, the differential pressure across the drive piston increases. When the downward force on the drive piston is sufficient to overcome static friction, the displacer 14 moves downwardly toward the cold end of the expander cylinder 12. As the displacer moves in the downward direction, cold low pressure gas in the cold end is displaced upwardly through the annular gap heat exchanger and into the regenerator 18. The annular gap heat exchanger absorbs heat from the environment outside of the cylinder 12. As this gas flows up through the regenerator, the regenerator screen material is cooled down further. This sequence of events is illustrated in FIG. 2.

Figure 3:
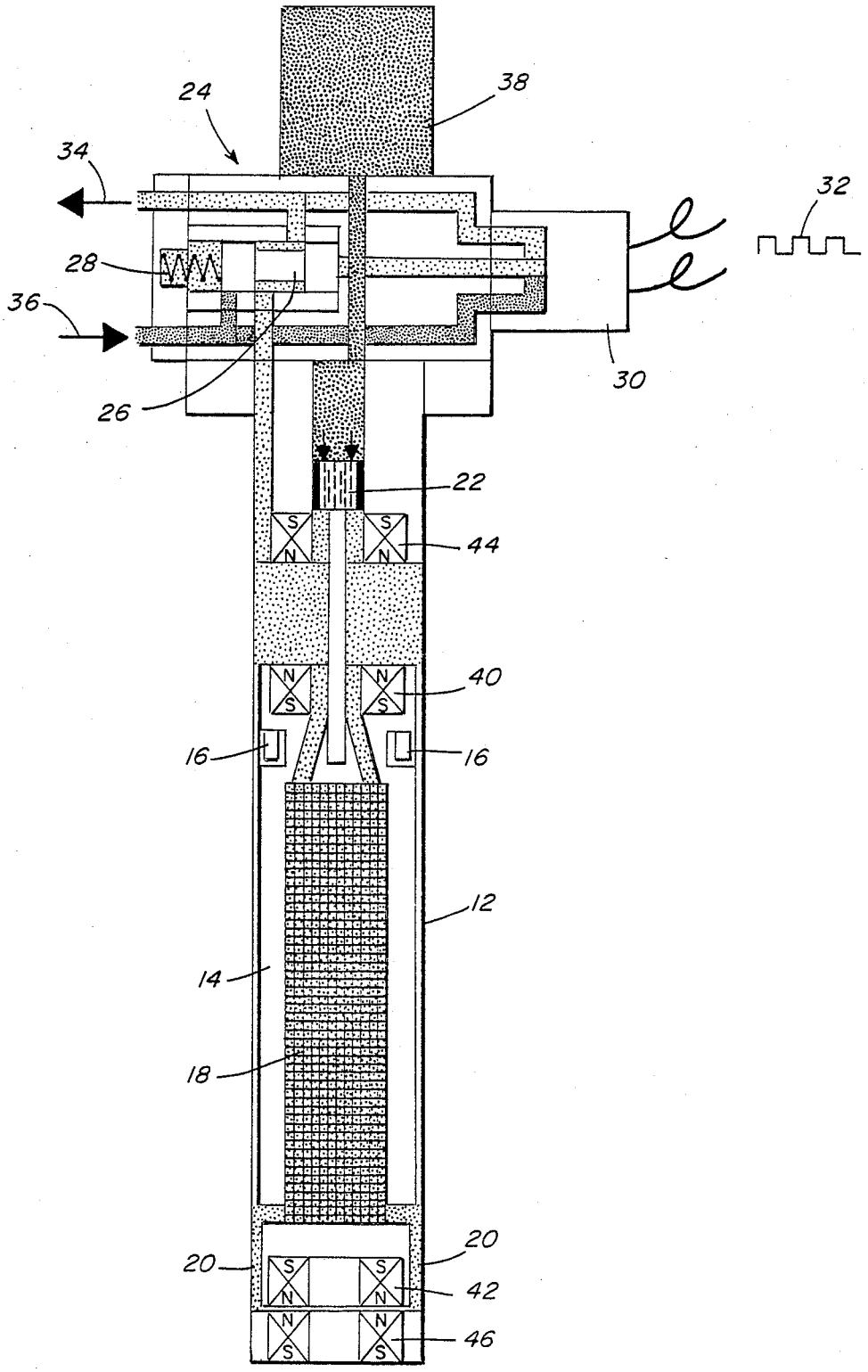
FIG. 3 is a view similar to that of FIG. 1 showing the displacer at its bottom (BDC) position.
Figure 4:
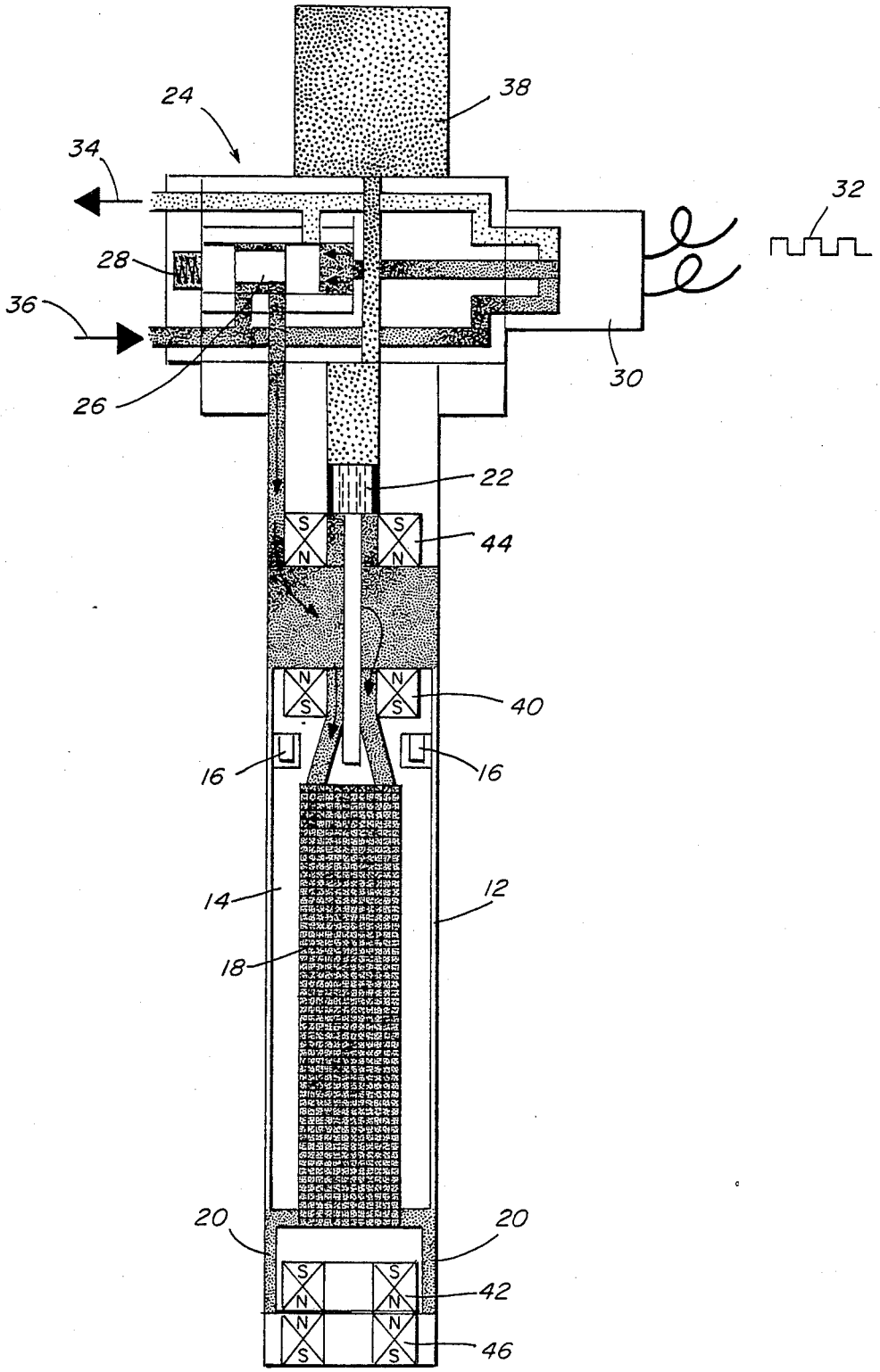
FIG. 4 is a view similar to that of FIG. 1 showing the actuation of the spool valve and pressurization of all of the internal volumes of the cooling engine.

Referring to FIG. 3, the downward motion of the displacer stops when the drive force of piston 22 is equally opposed by the lower magnetic spring comprising the lower displacer magnet 42 and its corresponding lower stationary magnet 46. The displacer 14 will remain in the position shown in FIG. 3 until the square wave control signal 32 actuates the three-way pilot solenoid valve 30 as depicted in FIG. 4.

With the three-way pilot solenoid valve actuated and the left-hand end always at low pressure, the right-hand side (as viewed in FIG. 4) of the spool valve is pressurized with high pressure gas from gas pressure source 36. Under these conditions, the spool then moves to the left inlet position thereby pressurizing all of the internal volumes of the cylinder 12.

Figure 5:
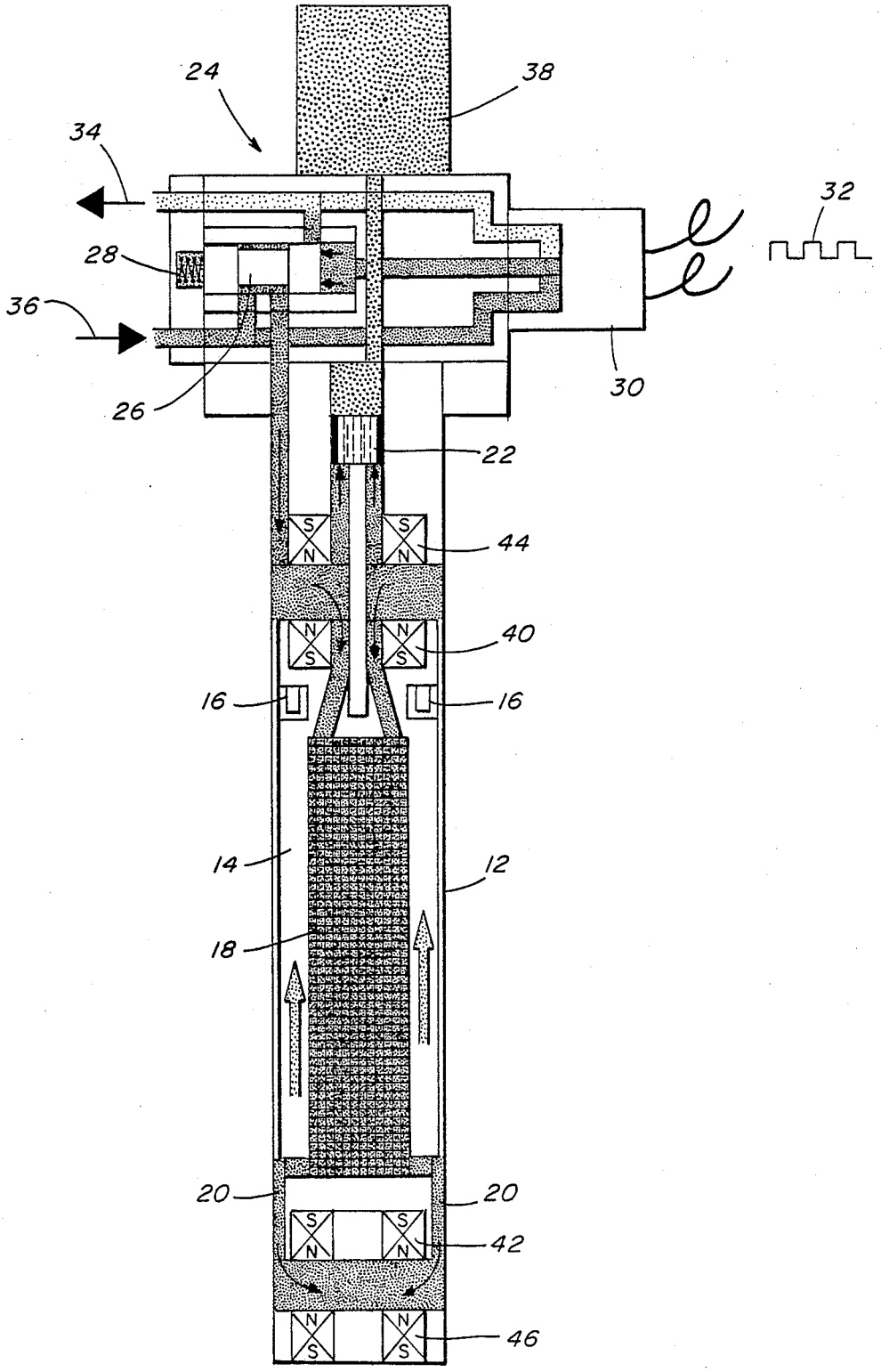
FIG. 5 is a view similar to that of FIG. 1 showing the upward movement of the displacer.
Figure 6:
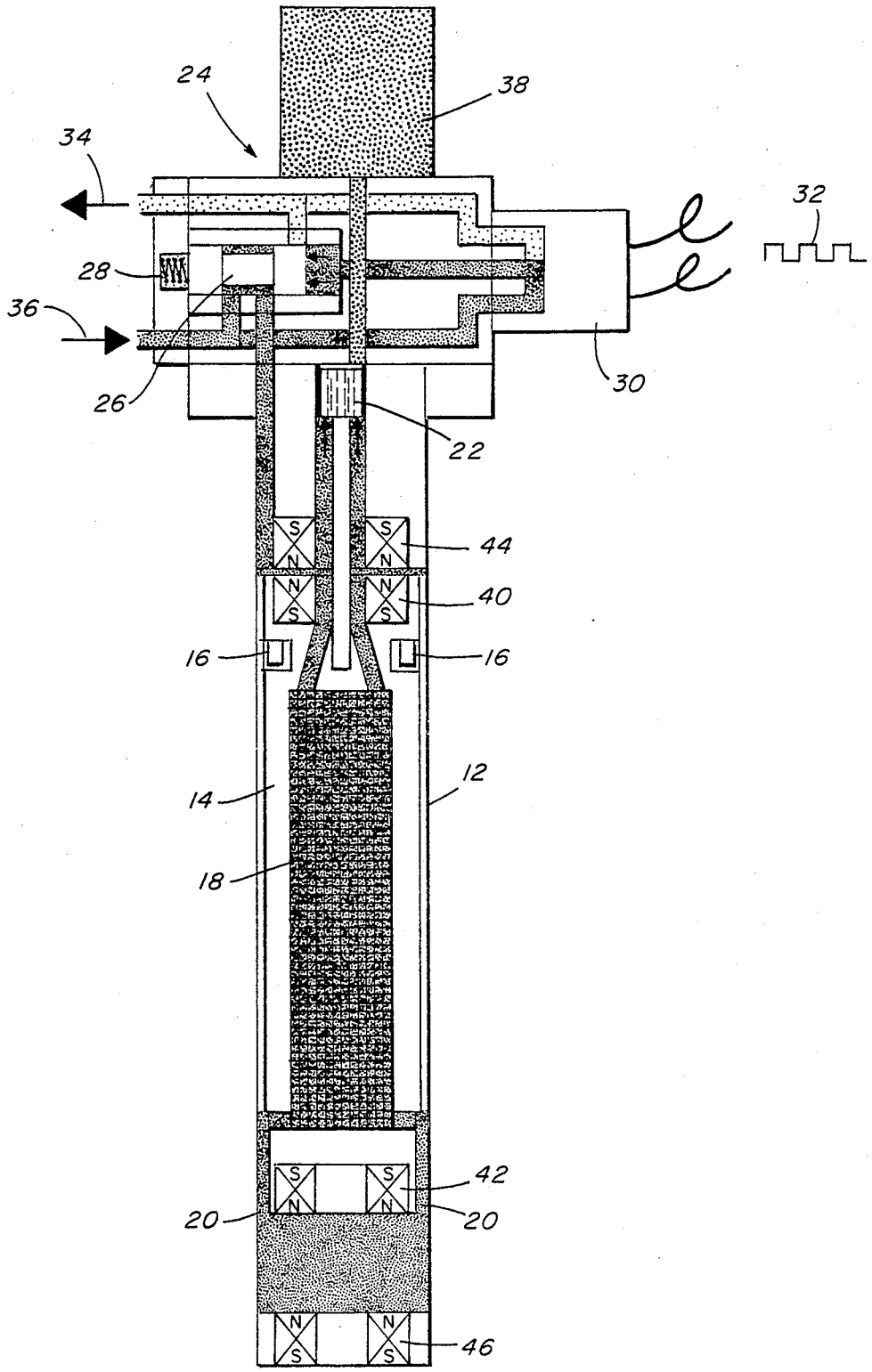
FIG. 6 is a view similar to that of FIG. 1 showing the displacer at its upper position (TDC) and prior to the exhaust cycle illustrated in FIG. 1.

Referring now to FIG. 5, when the differential gas pressure across the drive piston increases and the force is high enough to overcome static friction, the displacer 14 moves upwardly toward the warm end of the expander cylinder 12. As the displacer moves upwardly, the warm high pressure gas is displaced dowawardly through the regenerator 18. As the gas flows through the matrix material of the regenerator 18, it cools and contracts, drawing more gas downwardly through the regenerator.

As shown in FIG. 5, the upward motion of the displacer stops when the driving force of drive piston 22 is equally opposed by the upper magnetic spring comprising the previously mentioned upper displacement magnet 40 and upper stationary magnet 44. The cycle is now complete and a new cycle is ready to commence with the de-energization of the three-way pilot solenoid valve 30. At this point, the cooling engine components occupy the positions shown in FIG. 1.

Figure 7:
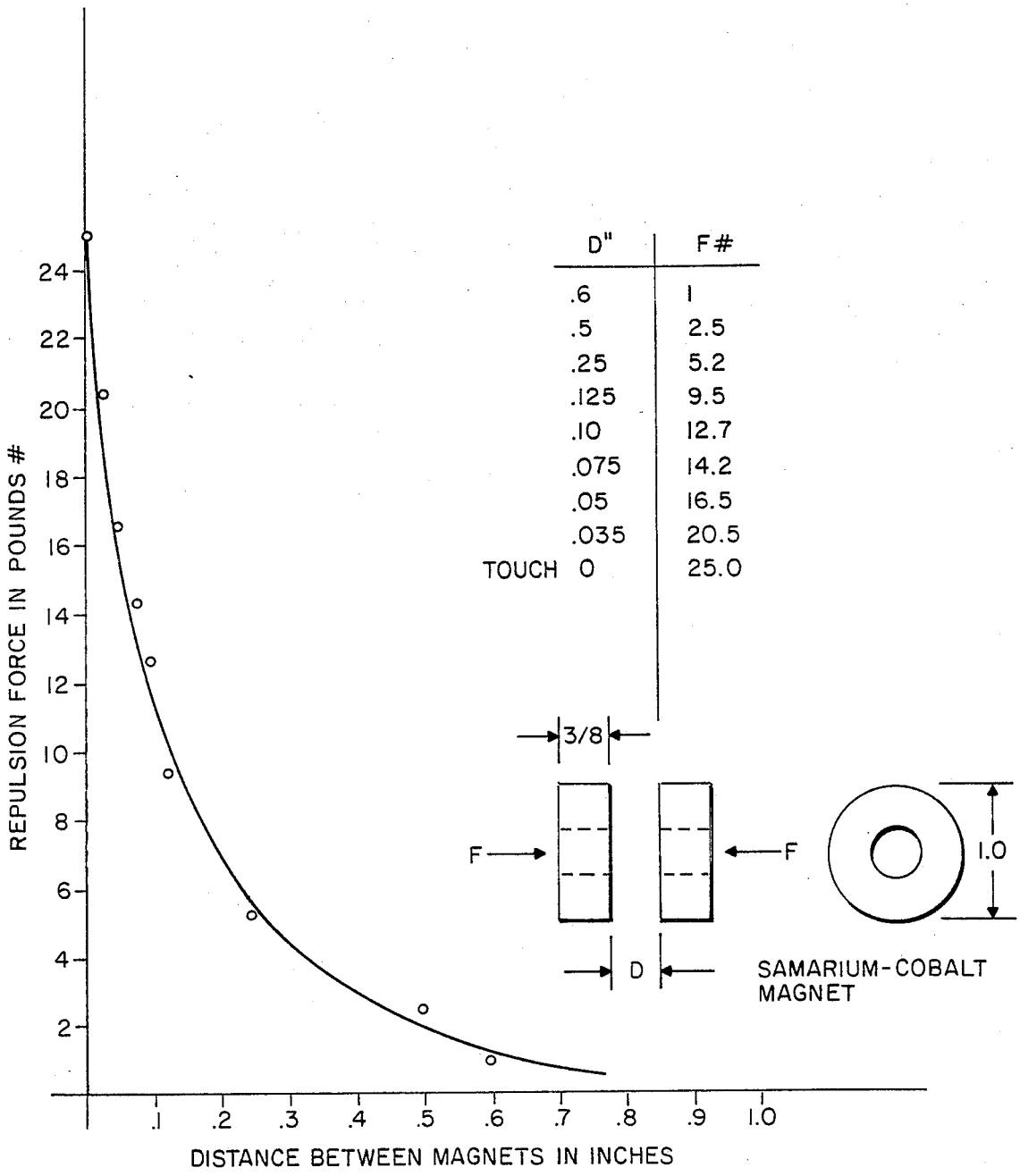
FIG. 7 is a plot of the magnetic repulsion force vs. distance between the magnets.

Referring now to FIG. 7, there is shown a plot of the magnetic repulsion force in pounds vs. the distance between magnets in inches for a samarium-cobalt magnet having a dimension shown on the plot. From an inspection of the plot, it can be seen that the repulsion force is non-linear with respect to distance and is inversely proportional thereto. The "magnet spring" produced by the repulsion forces between the stationary and displacer magnets stores kinetic energy to help move the displacer in the opposite direction as the displacer cycle changes. Unlike a mechanical spring configuration, the magnetic spring does not generate heat upon "compression" or introduce any void volume.

Figure 8:
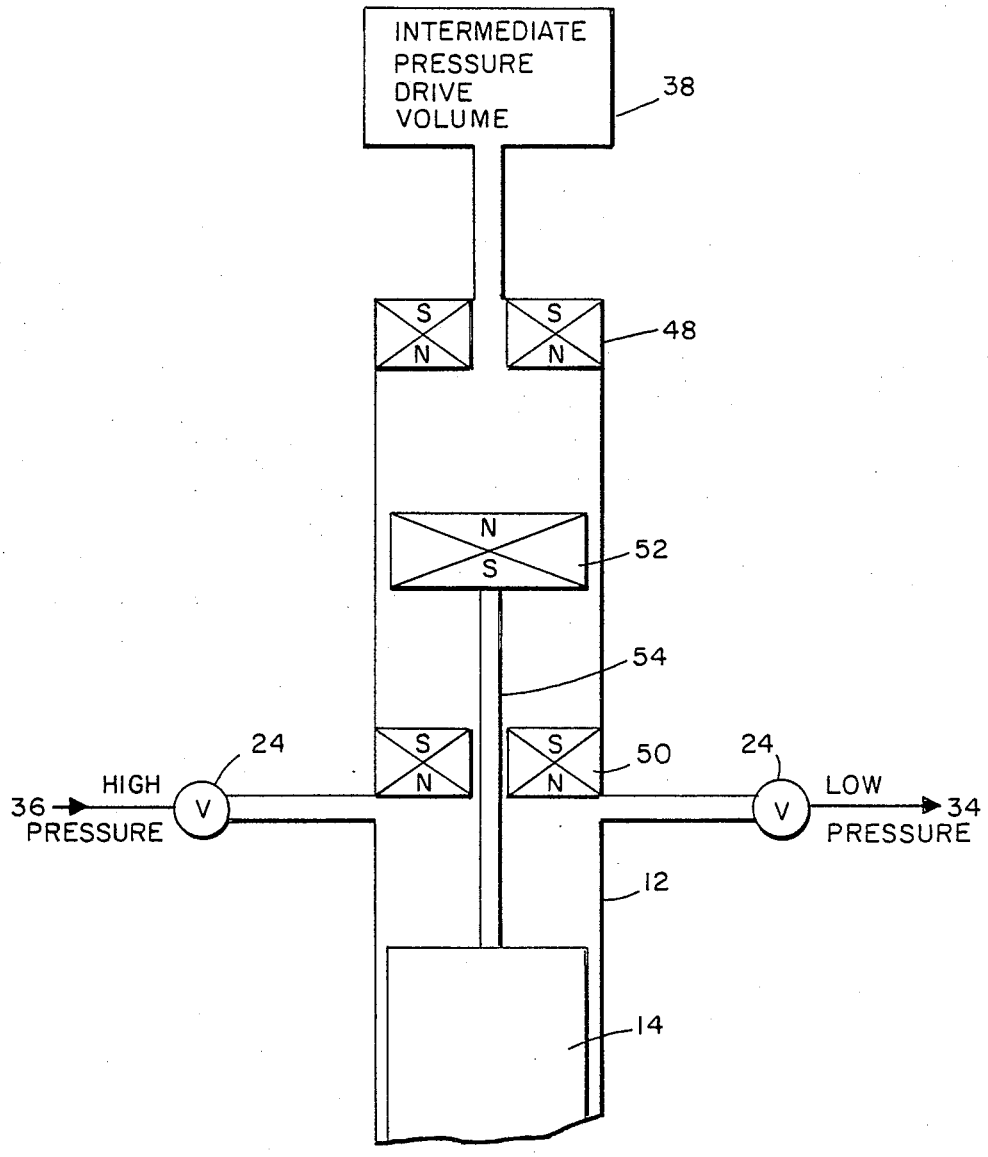
FIG. 8 is a simplified diagrammatic view in side elevation of a free, gas-driven displacer illustrating an alternative arrangement for generating the desired magnetic repulsion forces utilizing three magnets.

Referring now to FIG. 8, there is shown diagrammatically and in simplified form another embodiment of the invention which employs two stationary magnets, an upper stationary magnet 48, a lower stationary magnet 50 and an intermediate displacer magnet 52 that is mechanically connected to displacer 14 by means of shaft 54 so that the magnet 52, shaft and displacer 14 move as a unit. For purposes of illustration, the regenerator has been omitted from the displacer shown in this Figure. It can be seen in FIG. 8 that like poles of magnets 48 and 52 face each other and, similarly, like poles of magnets 50 and 52 face each other in order to provide the magnet repulsion force for snubbing the movement of displacer 14 as it approaches its TDC and BDC positions.

It will be appreciated that the preceding discussion has referred to a "cooling engine" 10 without specifying the particular type of cooling engine. The magnetic snubbing method and apparatus of the present invention can be used in conjunction with any free displacer (piston) cooling engine. Thus it is useful with a Gifford-McMahon cycle engine, a Solvay cycle engine and a split Sterling cycle engine. Furthermore, it should be understood that the regenerator can be located either internally or externally with respect to the displacer 14.

It should be understood that the displacer magnets 40 and 42 and the stationary magnets 44 and 46 shown diagramatically in the Figure can be either permanent magnets or electromagnets or any combination thereof. The use of one or more electromagnets provides a way of controlling the degree of repulsion, the linearity of the magnetic repulsion force and the timing of the application of the magnetic repulsion snubbing force. From an implementation standpoint, the simplest configuration, if one wishes to use electromagnets, is to provide permanent magnets for the displacer magnets 40 and 42 and electromagnets for the upper and lower stationary magnets 44 and 46, respectively. Using electromagnets for the stationary magnets, the repulsion force between the upper stationary magnet and upper displacer magnet can be turned off when the displacer is at top dead center and, similarly, the repulsion force between the lower stationary magnet and the lower displacer magnet can be turned off when the displacer is at bottom dead center. This timing arrangement permits both full intake and exhaust of the gas before displacer motion occurs and can be synchronized with the pilot valve square wave control signal 32 to optimize the gas expansion cycle.

Having described in detail a preferred embodiment of my invention, it will now be obvious to those skilled in the art that numerous modifications can be made therein without departing from the scope of the invention as defined in the following claims.

What I claim and desire to secure by Letters Patent of the United States is:

1. A method for snubbing the movement of a free, gas-driven displacer in a cooling engine as the displacer approaches top dead center and bottom dead center of its cycle said method comprising the steps of:

(1) generating a magnetic repulsion snubbing force between the displacer and the displacer containing cylinder of the cooling engine as the displacer moves in one direction in the cylinder; and, (2) generating another magnetic repulsion snubbing force between the displacer and the displacer containing cylinder of the cooling engine as the displacer moves in an opposite direction within the cylinder.

2. A method for snubbing the movement of a free, gas-driven displacer in a cooling engine as the displacer approaches top dead center and bottom dead center of its cycle said method comprising the steps of:

(1) generating a magnetic repulsion snubbing force between the displacer and one end of the displacer container cylinder of the cooling engine as the displacer approaches said one end; and, (2) generating a magnetic repulsion snubbing force between the displacer and the other end of the displacer container cylinder of the cooling engine as the displacer approaches said one end.

3. The method of claim 2 wherein each generated magnetic repulsion snubbing force is non-linear with respect to the distance between the displacer and the corresponding end of the cooling engine displacer containing cylinder.

4. The method of claim 3 wherein each generated magnetic repulsion snubbing force is inversely proportional to said distance.

5. The method of claims 1 or 2 further comprising the step of generating said magnetic repulsion snubbing forces with permanent magnets.

6. The method of claims 1 or 2 further comprising the step of generating said magnetic repulsion snubbing forces with a combination of permanent magnets and electromagnets.

7. The method of claim 3 further comprising the step of varying the non-linearity of at least one of the generated magnetic repulsion snubbing forces as the displacer approaches the end of the displacer containing cylinder associated with said at least one generated magnetic repulsion snubbing force.

8. The method of claims 1 or 2 further comprising the step of terminating the generated magnetic repulsion snubbing forces when the displacer reaches TDC and BDC.

9. The method of claims 1 or 2 further comprising the step of varying the magnitude of at least one of the generated magnetic repulsion snubbing forces.

10. In a cooling engine having a free, gas-driven displacer, the improvement comprising:

a first displacer magnet secured to and movable with the displacer and a first stationary magnet, said first magnets having like magnetic poles facing each other to generate a magnetic repulsion snubbing force as the displacer moves in one direction toward the first stationary magnet; and, a second displacer magnet secured to and movable with the displacer and a second stationary magnet, said second magnets having like magnetic poles facing each other to generate a magnetic repulsion snubbing force as the displacer moves in a second and opposite direction toward the second stationary magnet.

11. The cooling engine of claim 10 wherein each of said generated magnetic repulsion snubbing forces is non-linear with respect to the distance between the associated displacer magnet and its corresponding stationary magnet.

12. The cooling engine of claim 10 wherein each generated magnetic repulsion snubbing force is inversely proportional to each such distance.

13. The cooling engine of claim 10 wherein said displacer and stationary magnets are permanent magnets.

14. The cooling engine of claim 10 wherein the cooling engine is a Gifford-McMahon cycle engine.

15. The cooling engine of claim 10 wherein the cooling engine is a Solvay cycle engine.

16. The cooling engine of claim 10 wherein the cooling engine is a split Sterling cycle engine.

17. The cooling engine of claim 10 wherein said first and second stationary magnets are electromagnets.

18. The cooling engine of claim 10 wherein said displacer magnets are permanent magnets and said stationary magnets are electromagnets.

* * * * *